US007780395B2

(12) United States Patent
Satou

(10) Patent No.: US 7,780,395 B2
(45) Date of Patent: Aug. 24, 2010

(54) LIFT ARM FOR SKID-STEER LOADER

(75) Inventor: Kazuhisa Satou, Kawagoe (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 12/040,326

(22) Filed: Feb. 29, 2008

(65) Prior Publication Data

US 2009/0220328 A1 Sep. 3, 2009

(51) Int. Cl.
*E02F 9/00* (2006.01)

(52) U.S. Cl. ..... 414/722; 52/116

(58) Field of Classification Search ..... 414/722, 414/686; 29/891, 891.1; 52/111, 115, 116, 52/732.1

See application file for complete search history.

(56) References Cited

U.S. PATENT DOCUMENTS 3,939,997 A * 2/1976 Frank ..... 414/686

5,540,289 A * 7/1996 Hirooka et al. ..... 172/274

FOREIGN PATENT DOCUMENTS

JP 06-33476 2/1994
JP 2007-254986 10/2007

* cited by examiner

*Primary Examiner*—Donald Underwood
(74) *Attorney, Agent, or Firm*—Fish & Richardson P.C.

(57) ABSTRACT

A lift arm for a skid-steel loader, in which a pair of right and left lift arms are divided in two so that they are constituted as first arm portions and second arm portions. Each of the first arm portions is constituted as a long member which is constituted from a sheet metal material and a hollow portion is formed from a proximal end to a front end of the first arm portion. Reinforcing plate-shaped bodies are fixed on both side faces from a central portion to the front end. Each of the second arm portions is constituted from a plate-shaped body and constituted between a front wheel and a loader main body so as to be inserted loosely. With this structure, it is possible to provide the lift arm which enables an entire length of the skid-steer loader to be shortened.

4 Claims, 5 Drawing Sheets

LIFT ARM FOR SKID-STEER LOADER

BACKGROUND OF THE INVENTION

1. Field of the Invention

The present invention relates to a lift arm for a skid-steer loader.

2. Description of the Related Art

A skid-steer loader is constituted to be steered in a traveling direction by the difference of the number of rotations of both right and left wheels when they are rotated independently, respectively different from a wheel loader. Further, the skid-steer loader is constituted to support a lift arm in a rear portion of a loader main body. With this constitution, the entire length of the skid-steer loader can be shortened while a desired rotation stroke which is necessary to rotate the lift arm is obtained (refer to Japanese Patent Laid-Open Publication No. 6-33476).

Accordingly, the skid-steer loader can be made more compact than the wheel loader and moreover the rotation radius thereof can be shortened. Since the skid-steer loader has these advantages, it is preferably used in civil engineering works such as gardening and the like in a relatively narrow location.

As shown in FIG. 5, in a skid-steer loader 40 disclosed in Japanese Patent Laid-Open Publication No. 6-33476, since the front ends of lift arms 41 are disposed inside of the front wheels, the skid-steer loader 40 is constituted to widen a side field of view. However, since the skid-steer loader 40 is constituted to dispose the front ends of the lift arms 41 inside of the front wheels 47, cylinders 46 for actuating a bucket 42 are disposed below cylinders 43 for actuating the lift arms 41 approximately in parallel therewith. Moreover, connecting arms 44 rotated by the cylinders 46 and connecting rods 45 for transmitting the rotation of the connecting arms 44 to a bucket 42 are disposed forward of the lift arms 41 together.

Accordingly, since the two cylinders 43 and 46 must be disposed on each side of the skid-steer loader 40, the constitution of the skid-steer loader 40 is made complex. Further, cylinders having a long stroke must be used as the cylinders 46.

A lift arm for a skid-steer loader (refer to Japanese Patent Laid-Open Publication No. 2007-254986) and the like are proposed as the constitution in which cylinders for actuating a bucket are disposed to front end sides of lift arms, that is, to a front surface side of the skid-steer loader. Each of the lift arms 50 disclosed in Japanese Patent Laid-Open Publication No. 2007-254986 is divided to two as shown in FIG. 6 so that it is constituted as a first arm portion 51 rotatably supported by a rear portion of a loader main body 55 and a second arm portion 52 constituted downward to the front end side of the first arm portion 51.

The first arm portion 51 is constituted by welding a plurality of sheet metal materials, and the second arm portion 52 is integrally constituted from cast steel. Then, the second arm portion 52 is disposed so as to cover the upper surface of a front wheel 56. Accordingly, the entire length of the skid-steer loader 57 cannot help being made longer than the skid-steer loader 40 disclosed in Japanese Patent Laid-Open Publication No. 6-33476 due to the lift arm 50 constituted so as to cover the front wheel 56.

SUMMARY OF THE INVENTION

Since the rotation radius of a skid-steer loader is smaller than that of a wheel loader, it can perform even a spin turn. The skid-steer loader, which is smaller than the wheel loader and has a manipulating property of more excellent than the wheel loader as described above, can be used to various applications such as a ground leveling work and the like in a relatively small location.

The skid-steer loader can perform, for example, an excavating work, a loading work, and the like by a bucket disposed to front end sides of lift arms and can also perform a ground leveling work and the like making use of a side surface of the bucket and the like.

More specifically, in the skid-steer loader, since the same work attachment is used to various applications different from the wheel loader, the lift arms receive a relatively large lateral load at the front end sides thereof in addition to a longitudinal load.

Accordingly, the front end sides of the lift arms of the skid-steer loader must be provided with both a structure capable of supporting the longitudinal load and a structure capable of supporting the lateral load.

The structure of the lift arms 41 disclosed in Japanese Patent Laid-Open Publication No. 6-33476 can securely reduce the entire length of the skid-steer loader 40. However, the cylinders 46 having the long stroke are liable to receive the lateral load. Thus, when piston rods of the cylinders 46 are deformed by receiving the lateral load, the bucket 42 cannot smoothly perform a rotation work.

Further, in the skid-steer loader 57 disclosed in Japanese Patent Laid-Open Publication No. 2007-254986, since the lift arms 50 are made longer than those disclosed in Japanese Patent Laid-Open Publication No. 6-33476, it is difficult to more reduce the rotation radius of the skid-steer loader 57.

An object of the present invention, which was made in view of the above problems, is to provide a lift arm for a skid-steer loader which can simplify the structure of the lift arm to reduce the weight thereof, can dispose the front end side of the lift arm inside of front wheels, and can prevent deformation of actuators for rotating a work attachment such as a bucket when the work attachment receives a lateral load.

A lift arm for a skid-steer loader according to the present invention comprises: a pair of right and left first arm portions having proximal end sides rotatably supported by a rear portion of a loader main body and front end sides formed to extend in front of the loader main body; plate-shaped reinforcing bodies respectively attached to an outside surface and an inside surface of each of the first arm portions from a central portion to the front end side thereof; a pair of right and left second arm portions having proximal end sides respectively disposed to the front end sides of the first arm portions and front end sides formed to extend downward respectively; and a beam portion disposed between proximal ends and the front end sides of the respective second arm portions for coupling and reinforcing the pair of right and left second arm portions, wherein each of the first arm portions comprises a sheet metal material having a lateral sectional shape formed to a hollow rectangular shape; each of the second arm portions comprises a sheet metal material; the proximal end side of each of the second arm portions is attached to an inside surface side of each of the first arm portions, respectively; a lower surface side portion on the front end side of each of the first arm portions is coupled with an outside surface side portion on the proximal end side of each of the second arm portions through a reinforcing member; the plate-shaped reinforcing bodies comprise cylinder attachment portions for supporting front end sides of arm cylinders for rotating the first arm portions; the second arm portions comprise attachment mounting portions disposed to the front end sides thereof for rotatably supporting a work attachment; and actuator attachment portions are constituted on the front end sides of the first arm portions, that is, on the proximal end sides of the second arm portions to support proximal ends of actuators for operating the work attachment.

In the lift arm for the skid-steer loader according to the present invention, control harness, a piping and the like, which operate the actuators, are disposed in a hollow portion of each of the first arm portions.

According to the present invention, since the lift arm is divided to first arm portions and second arm portions, each of the first arm portions is constituted from a sheet metal material and has a lateral sectional shape formed to a hollow rectangular shape, and each of the second arm portions is also constituted from the sheet metal material. The first arm portion may be constituted to have the lateral sectional shape formed to the hollow rectangular shape by joining a bent sheet metal material by welding and the like or may be constituted to have the lateral sectional shape formed to the hollow rectangular shape by joining a plurality of sheet metal materials by the welding and the like.

The outside surface and the inside surface of the first arm portion having the lateral sectional shape formed to the hollow rectangular shape may be sandwiched by the plate-shaped reinforcing bodies, and the plate-shaped reinforcing bodies may be fixed to the first arm portion. Then, the second arm portion may be attached to the plate-shaped reinforcing body attached to the inside surface of the first arm portion.

As described above, provision of the second arm portions permits the pair of second arm portions to be inserted into the interval between front wheels and the loader main body. Moreover, since the first arm portions and the second arm portions can be constituted from the sheet metal material, the weight of the lift arm can be reduced.

Further, since the lower surface side portion on the front end side of the first arm portion is coupled with the inside surface side portion on the proximal end side of the second arm portion through the reinforcing member, the attachment strength of the second arm portion can be improved. Further, constitution of the beam portion for coupling and reinforcing the pair of second arm portions can prevent deformation of the second arm portions even if a lateral load acts on a work attachment supported by the front end sides of the second arm portions. As a result, the actuators, which are disposed approximately along the second arm portions to manipulate the work attachment, can be prevented from being deformed.

As described above, the entire length of the skid-steer loader can be shortened by the present invention as well as the rotation radius of the skid-steer loader can be shortened. Moreover, the actuators for manipulating the work attachment can be prevented from being deformed by the lateral load while the weight of the lift arm is reduced.

In the present invention, since the control harness, and the piping and the like to the actuators for manipulating the work attachment can be disposed in the hollow portion of each of the first arm portions, they can be protected so that they are not broken and damaged by collision and the like from the outside. Moreover, since the wirings of the control harness, the piping, and the like are covered with the first arm portion as compared with the conventional wirings of a control harness, a piping, and the like which are disposed along a side surface of a first arm portion, these wirings are unlike to be viewed from the outside, thereby the design of the skid-steer loader can be greatly improved.

DESCRIPTION OF THE PREFERRED EMBODIMENTS

A preferable embodiment of the present invention will be explained specifically below based on the accompanying drawings. A constitution, in which a work vehicle of the present invention is applied to a skid-steer loader, will be explained. However, any constitution of shape and layout, which can solve the problems of the present invention, may be also employed in addition to the constitution explained below. Accordingly, the present invention is not limited to the embodiment explained below and can be variously modified.

Embodiment

First, a skid-steer loader will be explained in its entirety and then a constitution of a lift arm will be explained.

Figure 1:
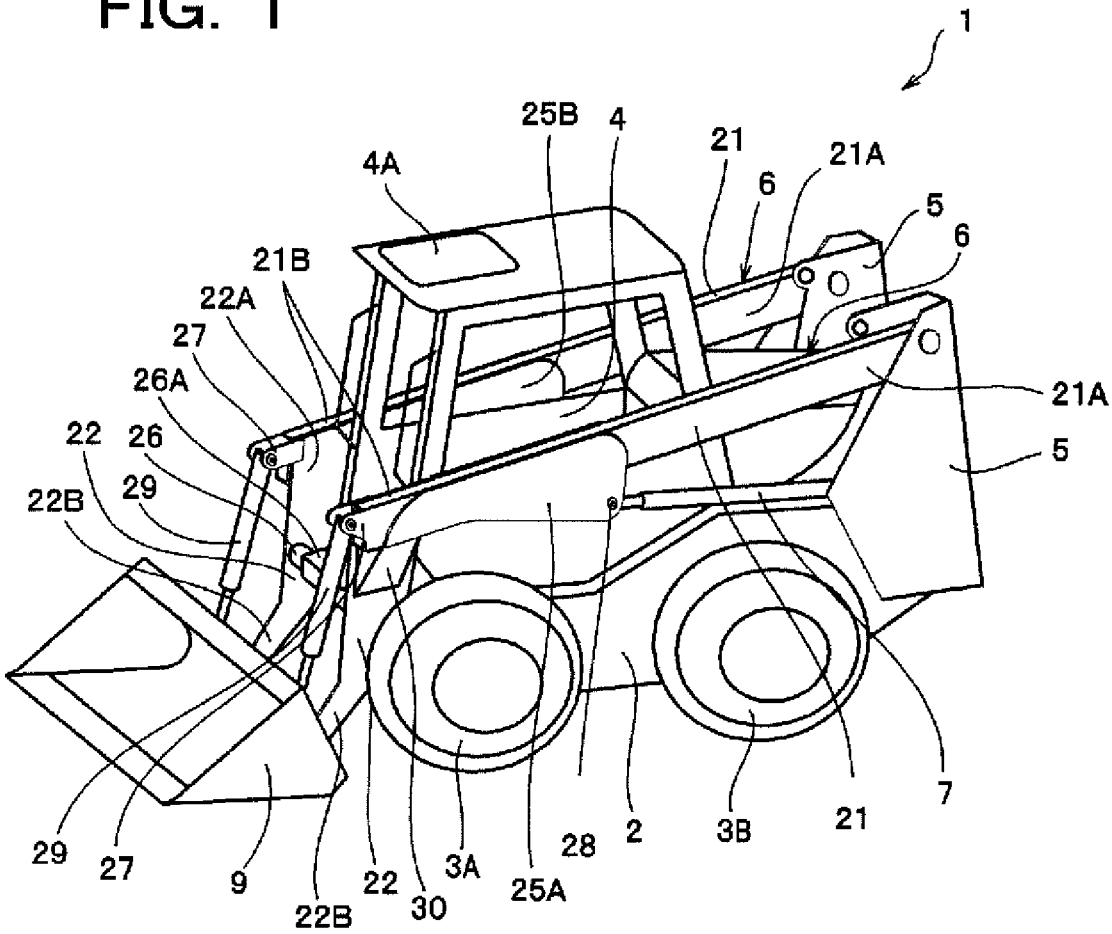
FIG. 1 is a perspective view of a skid-steer loader when it is viewed from a side surface.
Figure 2:
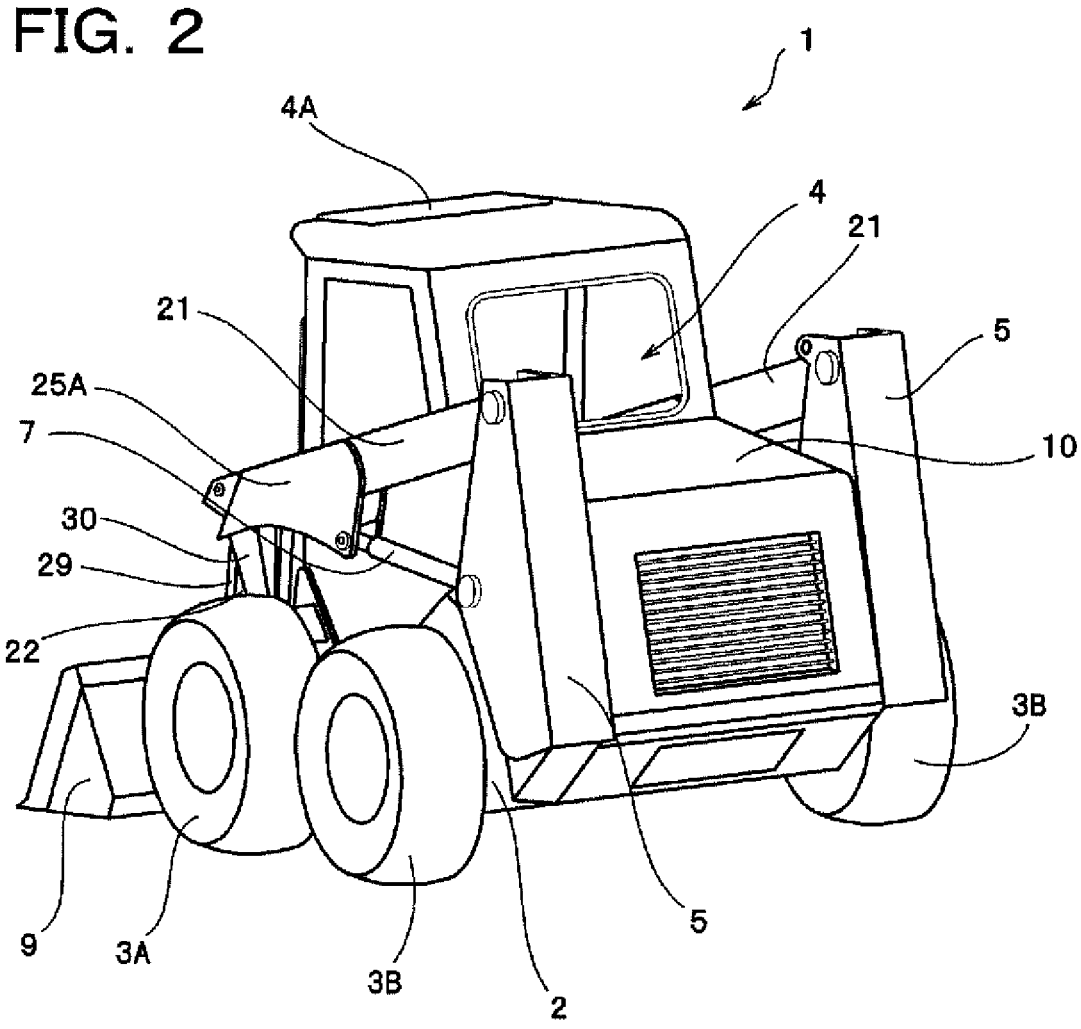
FIG. 2 is a perspective view of the skid-steer loader when it is viewed from a rear side.
Figure 3:
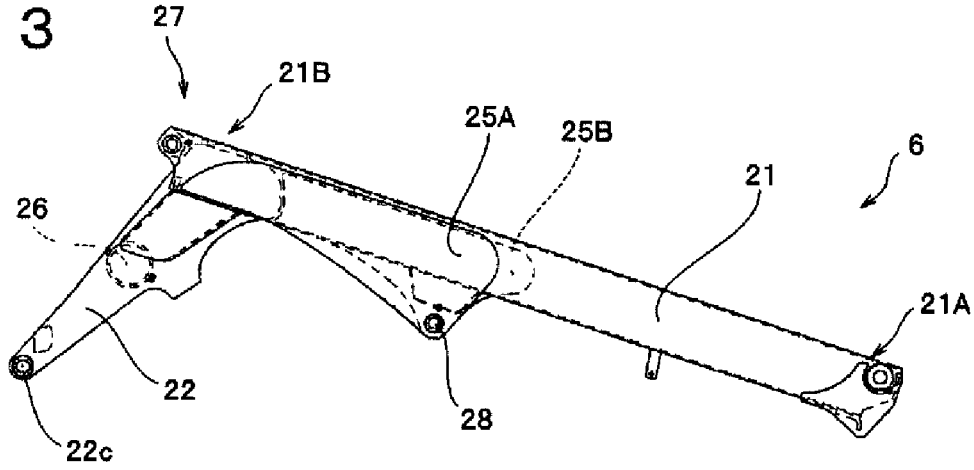
FIG. 3 is a side elevational view of one of lift arms.
Figure 4:
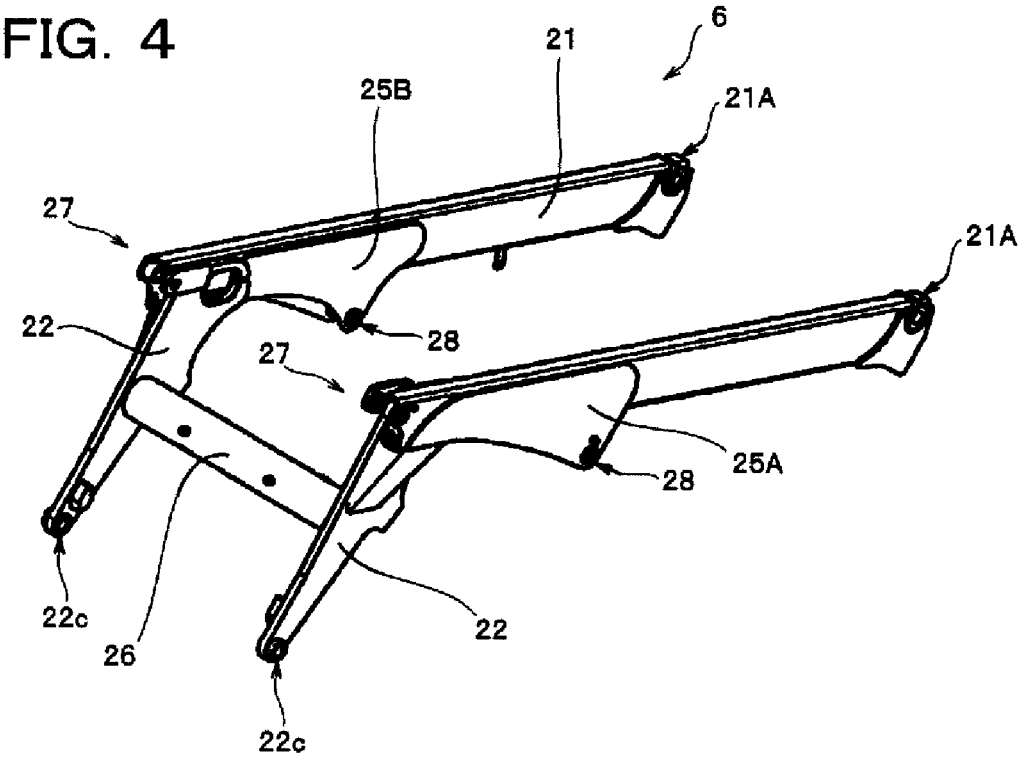
FIG. 4 is a perspective view of the lift arms.
Figure 5:
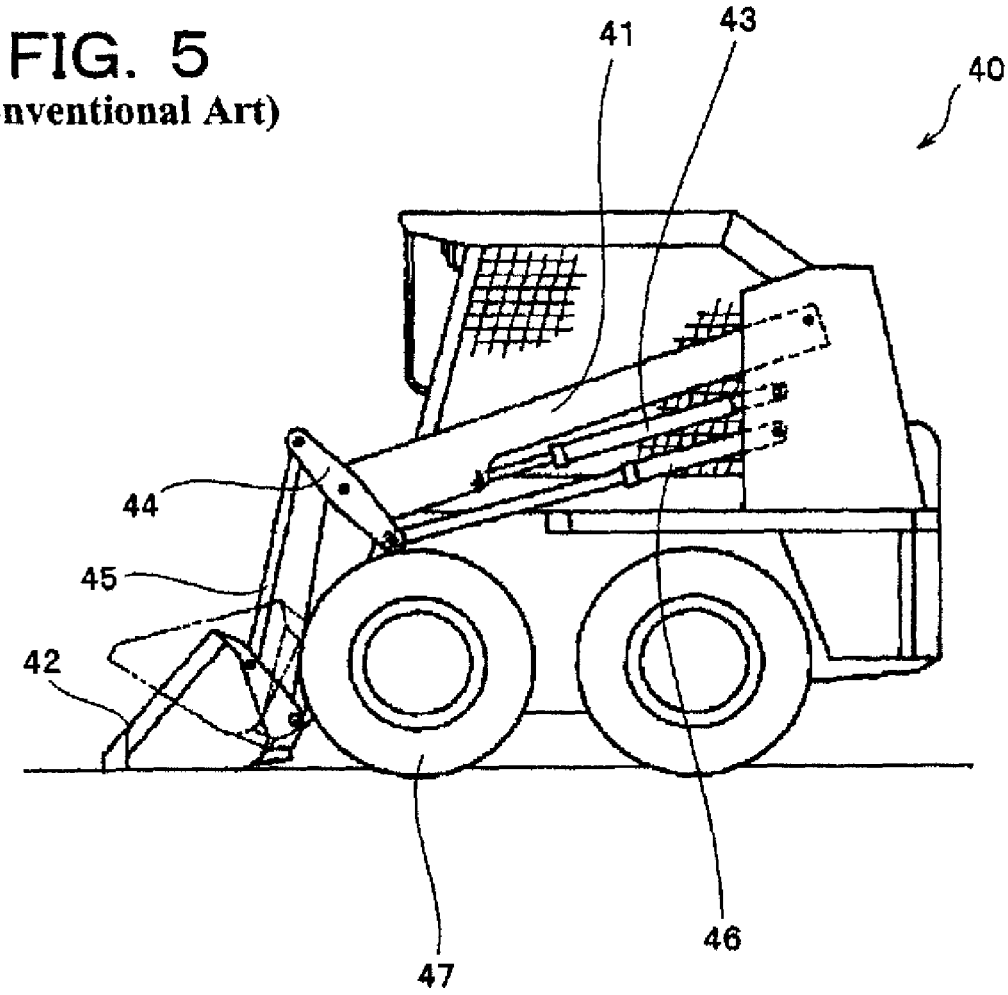
FIG. 5 (Conventional Art)
FIG. 5 is a side elevational view of a skid-steer loader of conventional example 1.
Figure 6:
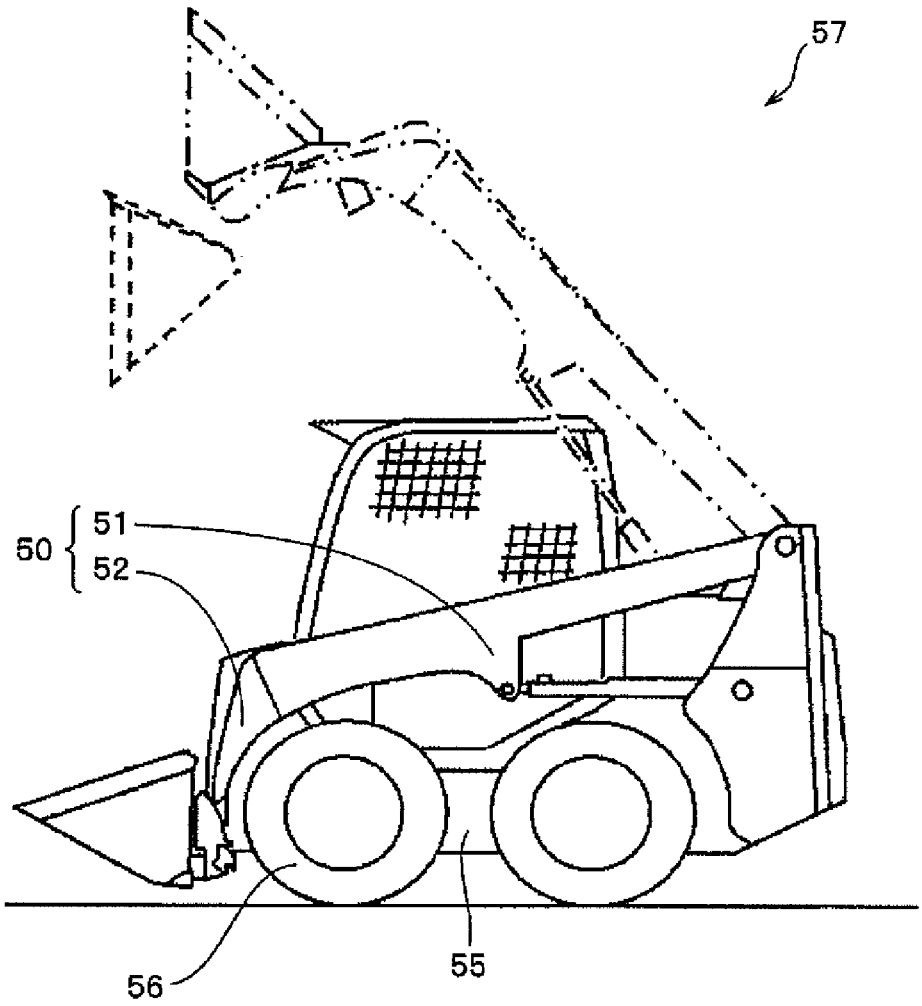
FIG. 6 (Conventional Art)
FIG. 6 is a side elevational view of a skid-steer loader of a conventional example 2.

FIG. 1 is a side perspective view of the skid-steer loader 1, and FIG. 2 is a rear perspective view of the skid-steer loader 1. FIG. 3 is a side elevational view of one of a pair of lift arms 6 when it is viewed from the outside. FIG. 4 is a perspective view of the lift arms 6.

As shown in FIGS. 1 and 2, the skid-steer loader 1 is constituted by including, for example, a loader main body 2, a pair of right and left front wheels 3A, a pair of right and left rear wheels 3B, a driver's seat 4, the lift arms 6, a pair of support portions 5 for rotatably supporting the lift arms 6, arm cylinders 7, a bucket 9, work machine cylinders 29 for rotating the bucket 9, and the like.

The loader main body 2 constitutes a vehicle body of the skid-steer loader 1, and the pair of right and left front wheels 3A is disposed to a front side of the loader main body 2 so that they can be independently driven in rotation, respective. The pair of right and left rear wheels 3B is disposed to a rear side of the loader main body 2 so that they can be independently driven in rotation, respectively. The attitude of the loader main body 2 can be controlled by changing the number of rotations of the right and left front and rear wheels 3A, 3B, thereby the loader main body can travel forward and rearward as well as perform a spin turn and the like. The number of rotations of the front and rear wheels 3A, 3B can be controlled by a not shown manipulation lever disposed to the driver's seat 4.

The driver's seat 4 is located at a position near to a front side of the loader main body and mounted to an upper portion of the loader main body. The driver's seat 4 is covered with a not shown net guard on the three surfaces thereof excluding a front surface (both right and left surfaces and a rear surface). An operator can climb in and climb out from the driver's seat 4 through the open front surface of the driver's seat 4. Further, a ceiling surface of the driver's seat 4 is at least partly constituted from a lattice-shaped ceiling portion 4A. Note that it is not necessary to cover all the three surfaces of the driver's seat 4 excluding the front surface with the net guard, and the driver's seat 4 may be constituted otherwise as long as the side fields of view and the rear field of view can be secured as well as the operator can climb in and climb out from the driver's seat 4.

A not shown engine and the like are accommodated in an engine cover 10 on a rear portion of the loader main body (refer to FIG. 2). Further, the pair of support portions 5 is disposed in both rear right and left portions of the loader main body so as to stand upward in order to support the pair of lift arms 6 on the proximal end sides thereof. The proximal end sides of the lift arms 6 are rotatably supported by the upper end sides of the respective support portions 5 through pins and the like.

The pair of lift arms 6 is integrally rotated upward and downward by the extending and contracting operation of the arm cylinders 7. The proximal end sides of the arm cylinders 7 are rotatably supported by the lower sides of the support portions 5 through pins and the like, and the front end sides of the arm cylinders 7 are rotatably supported by cylinder attachment portions 28 formed to plate-shaped reinforcing bodies 25A and 25B which constitute the lift arms 6. The cylinder attachment portions 28 can be constituted to approximately central portions of the arm cylinders 7.

When the arm cylinders 7 extend, the lift arms 6 move upward while they rotate upward. When the arm cylinders 7 are contracted, the lift arms 6 move downward and can return to the positions shown in FIGS. 1 and 2.

The front end sides of the lift arms 6 are bent downward in front of the loader main body 2, and a work attachment can be detachably mounted to the front end sides of the lift arms 6, that is, not shown attachment couplers and the like are disposed to the front end sides of the lift arms 6. Various types of work attachments such as the bucket 9, a fork, a sweeper, and the like can be detachably mounted to the attachment couplers and the like. Although the illustrated example shows that the bucket 9 is mounted as the work attachment, the bucket 9 is only an example of the work attachment, and the present invention is not limited thereto.

When the lift arms 6 move down to a lowest position, the angle between the front surface of the bucket 9 and the ground can be set to, for example, about 30°. When freight in the bucket 9 is loaded onto a truck and the like, the angle between the bucket 9 and the ground can be set to, for example, about 45°.

That is, the rotatable angle of the bucket 9 is set larger than that of a bucket of an ordinary wheel loader. Although the skid-steer loader 1 is constituted more compact than the wheel loader, since the height of a load-carrying platform of the track and the like to which freight is loaded therefrom is unchanged, a large rotatable angle is set to the bucket 9 so that a loading work can be smoothly performed.

Here, it is preferable to set the distance between the center of gravity of the bucket 9 and the centers of the front wheels 3A as short as possible. If the distance between the center of gravity of the bucket 9 and the centers of the front wheels 3A is set long, the size of the lift arms 6, which protrude forward of the loader main body 2 is increased. Thus, a balance weight must be mounted on the rear portion of the loader main body 2 to balance the freight loaded in the bucket 9 and the loader main body 2.

When the balance weight is mounted, the weight of the skid-steer loader 1 is increased as well as the entire size thereof is also increased. Thus, it is impossible for the skid-steer loader 1 to perform a work turning in a small radius, thereby the workability of the skid-steer loader 1 is deteriorated. Accordingly, it is preferable to set the distance between the center of gravity of the bucket 9 and the centers of the front wheels 3A as short as possible.

To satisfy the above condition, the present invention proposes a constitution of the lift arms 6 shown in FIGS. 3 and 4. That is, FIG. 3 shows a side elevational view of one of the lift arms 6, and FIG. 4 shows a perspective view of the lift arms 6, respectively. As shown in FIG. 3, each of the lift arms 6 is constituted as a first arm portion 21 and a second arm portion 22. The first arm portion 21 is constituted as a long member formed by bending, for example, a steel sheet and having an approximately rectangular lateral sectional shape, and the second arm portion 22 is constituted from a steel sheet.

The first arm portion 21 can be constituted as a hollow long member by constituting a long member having an approximately rectangular lateral sectional shape by bending, for example, a steel sheet at four positions and welding the approximately rectangular opening edge of the long member along the edge. Otherwise, the first arm portion 21 can be constituted as a hollow long member by welding a plurality of steel sheets with each other. Any constitution may be employed as the first arm portion 21 as long as the hollow portion thereof has a rectangular shape, and various modes of the constitution, for example, the apex portion of a character "A" is formed in parallel with a central lateral bar, and the like can be employed.

The plate-shaped reinforcing bodies 25A and 25B are attached on both the side surfaces of the first arm portion 21 from the vicinities of the central portions to the front ends thereof by a fixing means such as welding and the like. In the illustrated example, the plate-shaped reinforcing body 25A is attached to the outside surface of the first arm portion 21, and the plate-shaped reinforcing body 25B is attached to the inside surface thereof.

The cylinder attachment portions 28 are formed to the plate-shaped reinforcing bodies 25A and 25B, and the front end of the arm cylinder 7 are swingably supported by the cylinder attachment portions 28 to rotate the lift arm 6 upward and downward. The proximal end of the arm cylinder 7 is swingably supported by the support portion 5. The cylinder attachment portions 28 can be formed to an approximately intermediate part of the first arm portion 21.

The second arm portion 22 is fixed to the first arm portion 21 by the fixing means such as the welding and the like so that the second arm portion 22 constituted from a sheet-shaped body can be loosely inserted between the loader main body 2 and the front wheel 3A. That is, the interval between the pair of second arm portions 22 is made narrower than the interval between the front wheels 3A and moreover made wider than the width of the loader main body 2 on the front side thereof.

With this constitution, since the lift arms 6 do not interfere with the front wheels 3A when they are set to a lowermost position, the entire length of the skid-steer loader 1 can be shortened. Accordingly it is not necessary to mount the balance weight to the rear portion of the loader main body 2 to balance the freight loaded in the bucket 9 and the loader main body 2, and moreover the rotation radius of the skid-steer loader 1 can be shortened.

In order to increase the mounting strength on the side of the proximal end 22A of the second arm portion 22, the lower surface of the first arm portion 21 on the front end side thereof is strongly fixed to the outside surface of the second arm portion 22 on the side of the proximal end 22A thereof through, for example, a reinforcing member 30 formed to a triangular-prism shape. The reinforcing member 30 can be formed by bending a steel sheet. Since the reinforcing member 30 is constituted from the steel sheet, the weight of the first arm portion 21 can be reduced on the front end side thereof.

An attachment mounting portion 22*c* is formed to the front end side of the second arm portion 22 to rotatably support the bucket 9. An actuator attachment portion 27 is formed to the front end sides of the plate-shaped reinforcing bodies 25A and 25B which are located on the side of the proximal end 22A of the second arm portion 22 to support the proximal end of the work-machine cylinder 29 for actuating the bucket 9. The bucket 9 is swingably supported by the front end of the work-machine cylinder 29.

A beam portion 26 is disposed between the pair of second arm portions 22 in the intermediate portions thereof to couple both the second arm portions 22 with each other and to fix them. As shown in FIG. 1, a step 26A is attached on the beam portion 26 so that it acts as a foothold when the operator climbs in and climbs out from the driver's seat.

Further, not shown ribs may be appropriately disposed on a surface of the second arm portion 22. With this constitution, the rigidity of the second arm portion 22 can be increased. However, the ribs must be disposed on the surface of the second arm portion 22 so that the loose insertion of the second arm portion 22 between the loader main body 2 and the inside surface of the front wheel 3A is not prevented by the ribs.

As shown in FIG. 4, since each of the first arm portions 21 is constituted as the hollow long member, a hydraulic piping used to operate the work-machine cylinder 29, various types of sensors, a control harness for control units, a power supply cord, and the like can be disposed passing through the hollow portion of the first arm portion 21. Since the hydraulic piping, the control harness, and the like can be disposed in the hollow portion of the first arm portion 21 as described above, they can be protected from the danger of being damaged from the outside and placed in a safe state at all times by the first arm portion 21.

In the embodiment, the lift arms 6 are divided in two so that they are constituted as the first arm portions 21 and the second arm portions 22, and moreover the first arm portions 21, the plate-shaped reinforcing bodies 25A, 25B, the second arm portions 22, and the reinforcing bodies 30 are constituted from the steel sheet as described above. Further, since the second arm portions 22 are constituted from the steel sheet, the second arm portions 22 can be loosely inserted between the loader main body 2 and the inside surfaces of the front wheels 3A.

Note that the first arm portions 21, the plate-shaped reinforcing bodies 25A, 25B, the second arm portions 22, and the reinforcing bodies 30, which constitute the lift arms 6, can be constituted to such a thickness that the rigidity necessary to the respective members can be secured thereby.

With this constitution, the length of the lift arms 6 can be shortened, and moreover the constitution of the second arm portions 22, which is liable to become complex, can be simplified. Since the entire structure of the lift arms 6 can be simplified, the number of components constituting the lift arms 6 can be reduced, thereby a production efficiency can be enhanced as well as a manufacturing cost can be reduced.

Further, since the length of the lift arms 6 can be shortened, the skid-steer loader 1 of the present invention can be effectively used to various applications in a relatively narrow location. Since the lateral sectional shape of each of the first arm portions 21 is formed to the approximately rectangular shape and moreover the first arm portion 21 is reinforced by the plate-shaped reinforcing bodies 25A and 25B, the first arm portion 21 has the strength which can sufficiently withstand the longitudinal load. Since the second arm portion 22 is fixed to the first arm portion 21 by the plate-shaped reinforcing bodies 25A and 25B and the reinforcing member 30, the second arm portion 22 has the strength which can also sufficiently withstand the lateral load.

Further, since the wirings and the like, which are exposed to the outside in the conventional skid-steer loader, can be wired in the first arm portion 21 making use of the hollow portion thereof, these wirings and the like can be prevented from being corrupted and broken.

What is claimed is:

1. A lift arm and a skid-steer loader comprising:

a pair of right and left first arm portions disposed in a vehicle width direction of a loader main body, and a pair of right and left second arm portions disposed on front end sides of the first arm portions;

proximal end sides of the respective first arm portions rotatably supported by a rear portion of the loader main body and the front end sides of the respective first arm portions disposed extendedly from the rear portion of the loader main body toward a front side through a side portion of the loader main body;

plate-shaped reinforcing bodies respectively attached to an outside surface and an inside surface of each of the first arm portions from a central portion to the front end side thereof;

proximal end sides of the second arm portions respectively disposed on the front end sides of the first arm portions, front end sides of the second arm portions respectively disposed extendedly so as to direct downwardly on a front side of the loader main body from the front end sides of the respective first arm portions; and a beam portion disposed between proximal ends and the front end sides of the respective second arm portions for coupling and reinforcing the pair of right and left second arm portions, wherein each of the first arm portions comprises a sheet metal material having a lateral sectional shape formed to a hollow rectangular shape;

each of the second arm portions comprises a flat sheet metal material;

the proximal end side of each of the second arm portions is attached to an inside surface side of each of the first arm portions, respectively;

a lower surface side portion on the front end side of each of the first arm portions is coupled with an outside surface side portion on the proximal end side of each of the second arm portions through a reinforcing member;

the plate-shaped reinforcing bodies comprise cylinder attachment portions for supporting front end sides of arm cylinders for rotating the first arm portions;

the second arm portions comprise attachment mounting portions disposed to the front end sides thereof for rotatably supporting a work attachment; and actuator attachment portions are constituted on front end sides of the plate-shaped reinforcing bodies to support proximal ends of actuators for operating the work attachment.

2. The lift arm according to claim 1, wherein a control harness, a piping and the like, which operate the actuators, are disposed in a hollow portion of each of the first arm portions.

3. A lift arm for a skid-steer loader comprising:

a pair of right and left first arm portions disposable in a vehicle width direction of a loader main body, and a pair of right and left second arm portions disposed on front end sides of the first arm portions;

proximal end sides of the respective first arm portions rotatably supportable by a rear portion of the loader main body and the front end sides of the respective first arm portions disposable extendedly from the rear portion of the loader main body toward a front side through a side portion of the loader main body;

plate-shaped reinforcing bodies respectively attached to an outside surface and an inside surface of each of the first arm portions from a central portion to the front end side thereof;

proximal end sides of the second arm portions respectively disposed on the front end sides of the first arm portions, front end sides of the second arm portions respectively disposable extendedly so as to direct downwardly on a front side of the loader main body from the front end sides of the respective first arm portions; and a beam portion disposed between proximal ends and the front end sides of the respective second arm portions for coupling and reinforcing the pair of right and left second arm portions, wherein each of the first arm portions comprises a sheet metal material having a lateral sectional shape formed to a hollow rectangular shape;

each of the second arm portions comprises a flat sheet metal material;

the proximal end side of each of the second arm portions is attached to an inside surface side of each of the first arm portions, respectively;

a lower surface side portion on the front end side of each of the first arm portions is coupled with an outside surface side portion on the proximal end side of each of the second arm portions through a reinforcing member;

the plate-shaped reinforcing bodies comprise cylinder attachment portions for supporting front end sides of arm cylinders for rotating the first arm portions;

the second arm portions comprise attachment mounting portions disposed to the front end sides thereof for rotatably supporting a work attachment; and actuator attachment portions are constituted on front end sides of the plate-shaped reinforcing bodies to support proximal ends of actuators for operating the work attachment.

4. The lift arm for the skid-steer loader according to claim 3, wherein a control harness, a piping and the like, which operate the actuators, are disposed in a hollow portion of each of the first arm portions.

* * * * *

UNITED STATES PATENT AND TRADEMARK OFFICE

CERTIFICATE OF CORRECTION

PATENT NO. : 7,780,395 B2
APPLICATION NO. : 12/040326
DATED : August 24, 2010
INVENTOR(S) : Kazuhisa Satou It is certified that error appears in the above-identified patent and that said Letters Patent is hereby corrected as shown below:

On the cover page, the Assignee information should be:

(73) Assignee(s): Komatsu Ltd., Tokyo, (JP)
Komatsu Utility Co., Ltd., Tokyo, (JP)

Signed and Sealed this
Seventeenth Day of May, 2011

David J. Kappos

David J. Kappos
*Director of the United States Patent and Trademark Office*